US005305024A

United States Patent [19]

Moriguchi et al.

[11] Patent Number: 5,305,024

[45] Date of Patent: Apr. 19, 1994

[54] RECORDING HEAD AND RECORDING APPARATUS USING SAME

[75] Inventors: Haruhiko Moriguchi; Nobuhiko Takekoshi, both of Yokohama, Japan

[73] Assignee: Canon Kabushiki Kaisha, Tokyo, Japan

[21] Appl. No.: 649,732

[22] Filed: Feb. 1, 1991

[30] Foreign Application Priority Data

Feb. 2, 1990 [JP] Japan ..... 2-022189

[51] Int. Cl.[5] ..... B41J 2/005

[52] U.S. Cl. ..... 346/140 R; 346/76 PH

[58] Field of Search ..... 346/76 PH, 140 PD

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,521,786 | 6/1985 | Bain | 346/140 R |
| 4,558,333 | 12/1985 | Sugitani et al. | 346/140 R |
| 4,574,293 | 3/1986 | Inui et al. | 364/76 PH |
| 4,723,129 | 2/1988 | Endo et al. | 346/1.1 |
| 4,740,796 | 4/1988 | Endo et al. | 346/1.1 |
| 4,835,549 | 5/1989 | Samejima et al. | 346/76 PH |

FOREIGN PATENT DOCUMENTS

| | | |
|---|---|---|
| 0288044 | 10/1988 | European Pat. Off. . |
| 031828 | 5/1989 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

A recording head using thermal energy includes a plurality of heat generating elements for producing thermal energy; a waveform storing circuit for storing waveform data for a driving signal or signals applied to one or more predetermined number of heat generating elements; and a driving signal applying device for applying to each of the predetermined number of heat generating elements the driving signal or signals on the basis of the waveform data stored in said storing circuit, in accordance with a record image signal or signals.

41 Claims, 7 Drawing Sheets

RECORDING HEAD AND RECORDING APPARATUS USING SAME

FIELD OF THE INVENTION AND RELATED ART

The present invention relates to a recording head and a recording apparatus using the same, more particularly to a recording head and a recording apparatus using thermal energy produced by heat generating element as in a thermal transfer type or ink jet type.

In a thermal recording head of a heat-sensitive type or a thermal transfer type and an ink jet recording head wherein droplets of ink are ejected using thermal energy and are deposited on the recording medium, the properties of the individual heat generating elements of such a recording head are not uniform due to the manufacturing variation and due to the long term use. This would result in non-uniform image density in the recorded image.

Therefore, it is known that the properties of the heat generating elements are inspected at regular intervals or as desired, that in accordance with the properties detected, the waveform of driving pulses applied is set for the respective heat generating elements, by which the quantities of the heat by the elements are corrected to avoid the non-uniformity of the image density.

However, in the known system, the image signal, that is, the signal indicative of the application of the driving pulse or the non-application of the driving pulse, that is, formation of a record dot or non-formation of the dot on the recording sheet, is used as the driving pulse signal.

Therefore, in the drive control of the recording head, the control of the waveform is carried out for the driving pulse for each of the heat generating elements at a signal transfer frequency which is required for the record image signal. As a result, the circuit structure for the waveform control is bulky and costly.

Generally, the waveform of the driving pulse is represented with plural bits. For example, when the pulse width of the waveform is modulated, 16 pulse widths can be provided by four bits. Then, where the image signal is used as the waveform signal for the driving pulse, as described above, and it is transferred at the image signal transfer frequency, 4 bit parallel transfer is required because of the speed at which the waveform control is effected. This results in bulky and complicated structures of the recording head because of the numerous signal lines in the electric interface.

SUMMARY OF THE INVENTION

Accordingly, it is a principal object of the present invention to provide a recording head and a recording apparatus providing images of uniform image density with simple structure.

It is another object of the present invention to provide a recording head and a recording apparatus wherein non-uniformity of properties of recording elements are corrected with a simple structure.

It is a further object of the present invention to provide a recording head and a recording apparatus wherein the non-uniformity of properties of heat generating elements are corrected with a simple structure, by which the uniform images can be provided.

According to an aspect of the present invention, there is provided a recording head using thermal energy, comprising: a plurality of heat generating elements for producing thermal energy; waveform storing means for storing waveform data for a driving signal or signals applied to one or more of a predetermined number of heat generating elements; and driving signal applying means for applying to each of the predetermined number of heat generating elements the driving signal or signals on the basis of the waveform data stored in said storing means, in accordance with a record image signal or signals.

According to another aspect of the present invention, there is provided a recording apparatus using plural recording elements, comprising: a recording head including a plurality of heat generating elements for producing thermal energy; waveform storing means for storing waveform data for a driving signal or signals applied to one or more of a predetermined number of heat generating elements; and driving signal applying means for applying to each of the predetermined number of heat generating elements the driving signal or signals on the basis of the waveform data stored in said storing means, in accordance with a record image signal or signals; and control means for transferring the record image signal to said drive signal applying circuit and for controlling timing of the application of the drive signal.

With the structures of the present invention, the waveform data for the driving pulse is stored in a waveform strength circuit, and the driving pulse provided in accordance with the waveform data is applied to the corresponding heat generating element in response to the record image signal, and therefore, the drive control is easily performed with smaller structure.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
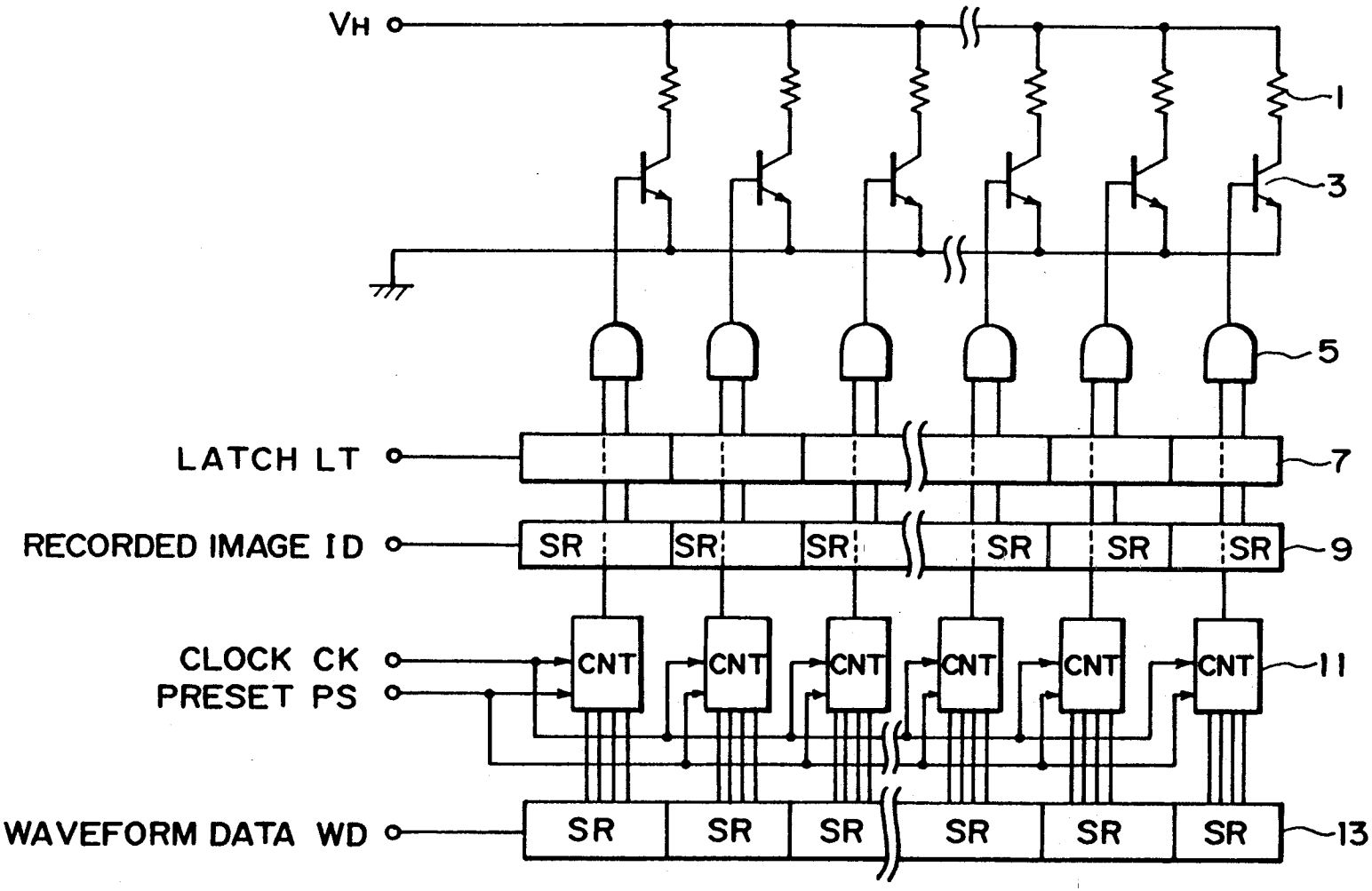
FIG. 1 is a circuit diagram of a recording head driving circuit of a recording head and a recording apparatus according to an embodiment of the present invention.

FIG. 1 is a circuit block diagram of a driving circuit for an ink jet recording head of a so-called full-line type, according to an embodiment of the present invention. A heat generating element having an electrothermal transducer element is provided for each of approximately 3000 ejection or discharge outlets covering a width of the recording sheet. The thermal energy produced by the heat generating element 1 produces a bubble in the ink by film boiling. By the expansion of the bubble, the ink is ejected through the ejection outlet in the form of a droplet. The electric potential difference between the opposite ends of the heat generating element 1 is a driving voltage VH through a switching transistor 3. A base of the transistor 3 is connected to the output side of the associated AND gate 5.

In FIG. 1, a shift resistor 13 functions to store one bit serial signal WD bearing waveform data supplied from a controller of the ink jet recording apparatus. In this embodiment, the pulse width of the driving pulse is modulated in 16 steps. Therefore, consecutive four bits of the waveform data signal WD constitute one waveform data for the driving pulse. To enable this, the shift resistor 13 has approximately 3000×4 bits, corresponding to the approximately 3000 heat generating elements 1. A counter 11 is provided for each of the heat generating elements. In accordance with a pre-set signal PS from the controller of the recording apparatus, the 4 bit parallel waveform data transferred from the shift resistor 13 are set. The counter counts the clockpulses supplied from the controller the set waveform data, that is, counts as many as the clockpulses corresponding to the pulse width of the waveform, and the counter produces "H" level during the counting.

In FIG. 1, a shift resistor 9 functions to store 1 bit serial record image signal ID. It has approximately 3000 bits, corresponding to the heat generating elements 1. A data buffer 7 latches in accordance with a latch signal LT the recording image signal ID produced from the shift register 9. Each of the AND gates 5 receives the associated output of the data buffer and receives an output of the associated counter 11.

Figure 2:
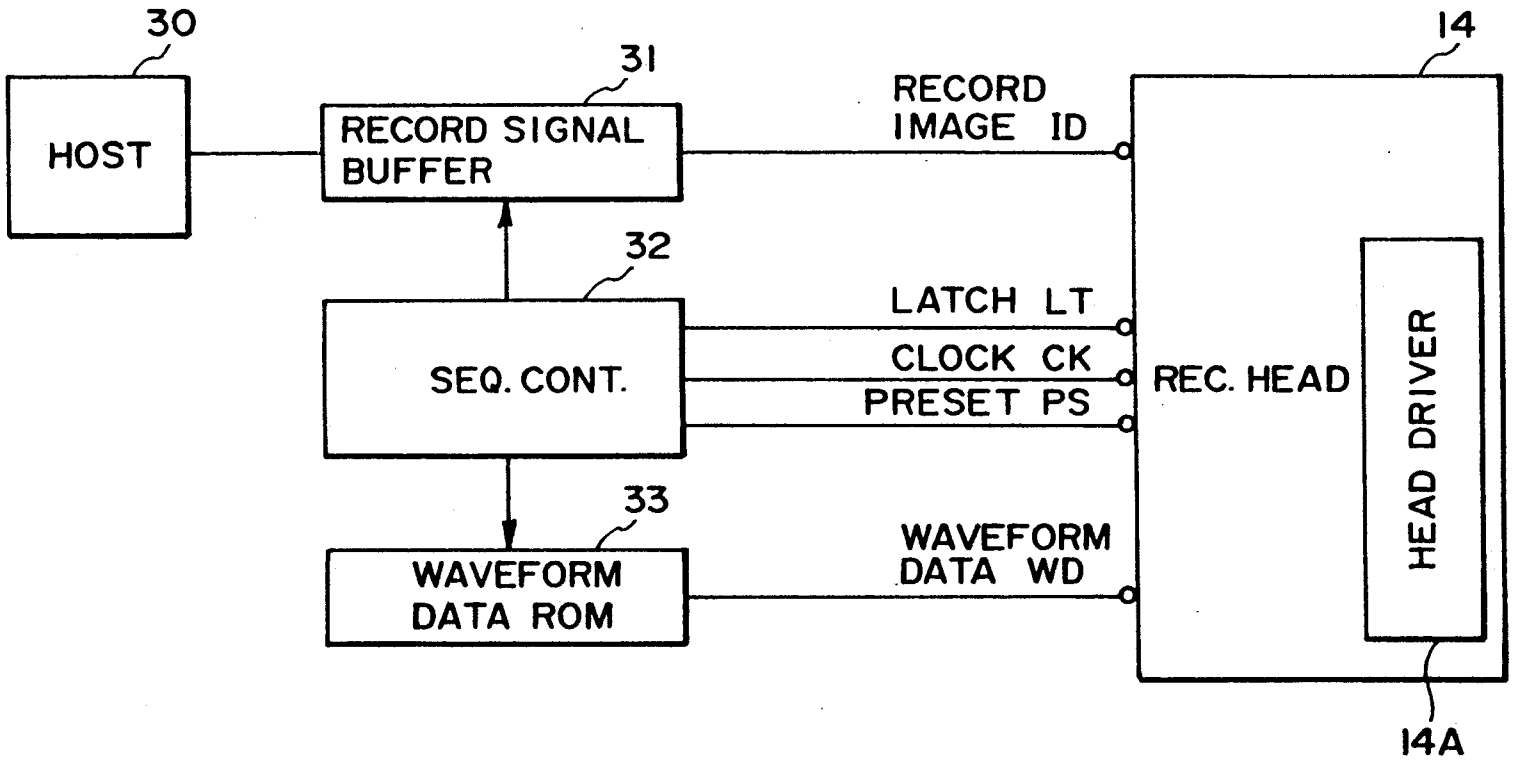
FIG. 2 is a block diagram of a control system for controlling the head driving circuit of FIG. 1.

FIG. 2 is a block diagram showing in detailed the controller for controlling the head driver circuit by transferring the above-described various signals to the head driver circuit 14A shown in FIG. 1, of the recording head 14. In FIG. 2, a record image signal buffer 31 is effective to temporarily store the record image signal supplied from a host machine 30 such as a microcomputer. The buffer 31 functions to adjust the deviation between the record image signal transfer timing by the host machine 30 and the driving timing of the recording head 14 in response to the image signal.

The machine for transferring the record image signal ID is not limited to the host machine such as computer, but it may be an original or document reader of a copying machine, facsimile machine, word processor or the like which is used with the ink jet recording apparatus of this embodiment as a printer, or it may be a simple input terminal such as keyboard in a printer.

In FIG. 2, a wave data ROM 33 stores the waveform data WD for the driving pulse in accordance with the image density. The waveform data WD are stored in the ROM 33 for the individual heat generating elements when the apparatus is delivered from a plant or when a service man's adjusting operation is effected at regular intervals or at irregular intervals.

A sequence controller 32 has a CPU or the like to control the record image signal transfer from the record image signal buffer 31 to the head driver circuit 14A and the waveform data WD transfer from the waveform data ROM 33 to the head driver circuit 14A. It also functions to supply the latching signal LT, the clock signal CK and the preset signal PS to the head driver circuit 14A at the proper timing.

Figure 3:
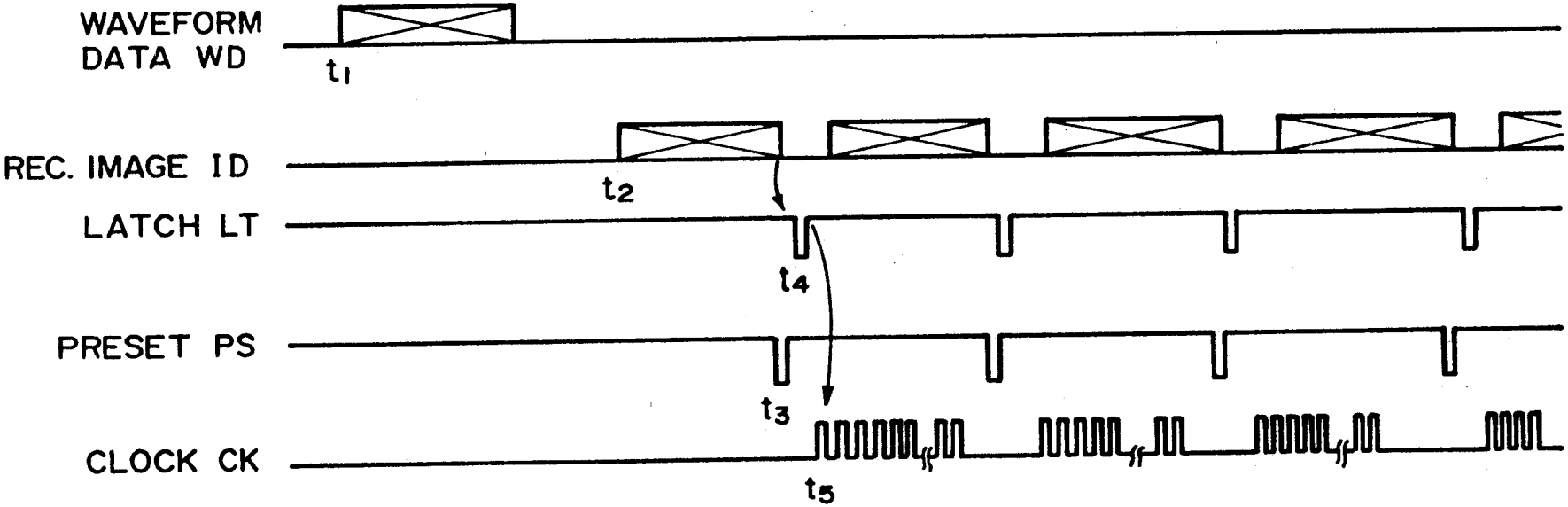
FIG. 3 is a timing chart for the signals controlling the head driving circuit of FIG. 1.

FIG. 3 is a timing chart showing the transfer timing of each of the signals described above. Referring to FIG. 3, the operational timing in the structure illustrated in FIGS. 1 and 2, will be described.

By the initial setting operation performed upon actuation of the main switch of the ink jet recording apparatus of this embodiment, the waveform data WD which have been set for the individual approximately 3000 heat generating elements, are transferred from the waveform data ROM 33 to the shift register 13, at timing $t_1$ in FIG. 3. Upon start of the recording operation, the record image signal ID is transferred from the record image signal buffer 31 to the shift register 9 in synchronism with the timing of the recording sheet feeding (timing $t_2$). After the completion of this transfer, the record image signal ID is latched at the data buffer 7 in response to the latching signal LT having the level "L" (timing $t_4$) and the output of the data to the AND gate 5 is set.

Prior to the "L" pulse of the latch signal LT, the waveform data WD stored in the shift register 13 are set in the counters 11 in response to the preset signal PS having the level "L" (timing $t_3$).

When the output form the data buffer 7 is set in response to the "L" level of the latching signal LT (timing $t_4$), the transfer of the clock signal CK starts (timing $t_5$). Then, the counter 11 counts the clock signal pulses only during the period corresponding to the waveform data WD set in the counter, and during the counting, an output of the counter to the AND gate 5 is rendered "H".

As a result of the operations described above, the driving pulses are applied to the heat generating elements 1 for which the record image signals ID supplied from the data buffer 7 are "H", and the driving pulses have widths corresponding to the durations in which the logic "H" levels are supplied from the counter 11 so that consistent ink droplets are ejected irrespective of the variations in the heat generating elements per se. In this manner, the recording operation is effected for one line corresponding to the length of the array of the ejection outlets of the recording head. During the recording head driving for one line, that is, during the period between an "L" level of the latching signal LT and the subsequent "L" level thereof, the record image signal ID for the next line is supplied to the shift register 9, and the recording operation for the next line is effected in the similar manner.

Figure 4:
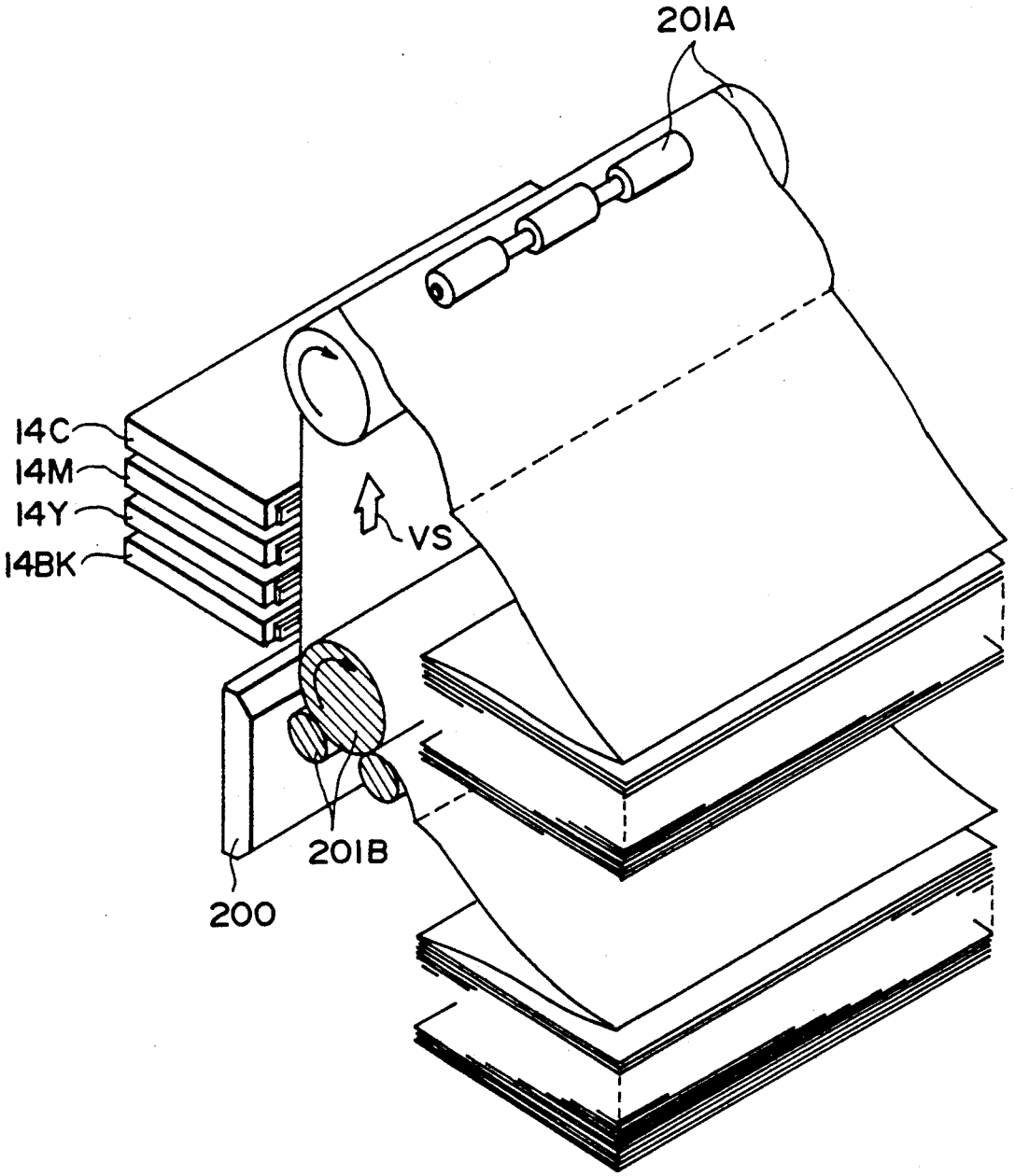
FIG. 4 is a perspective view of an example of an ink jet recording head to which the present invention is applicable.

FIG. 4 shows an example of an ink jet recording apparatus using the recording head and the driving system described in the foregoing. It is a perspective view of a full-color printer provided with four full-line type recording heads.

In FIG. 4 the printer comprises pairs of rollers 201A and 201B for feeding the recording material R in a sub-scan direction Vs. It also comprises full-line type recording heads for black, yellow, magenta and cyan recording, each having approximately 3000 ejection outlets covering an entire recording width of the recording material R, as described in the foregoing. They are disposed in the order named from the upstream side with respect to the feeding direction of the recording material.

A recovery system 200 is brought into facing relation to the recording heads 14BK–14C in place of the recording material R upon an ejection recovery operation. However, in this example, the frequency of the ejection recovery operations can be remarkably reduced because a preliminary heating operation is carried out at proper timing.

Figure 5:
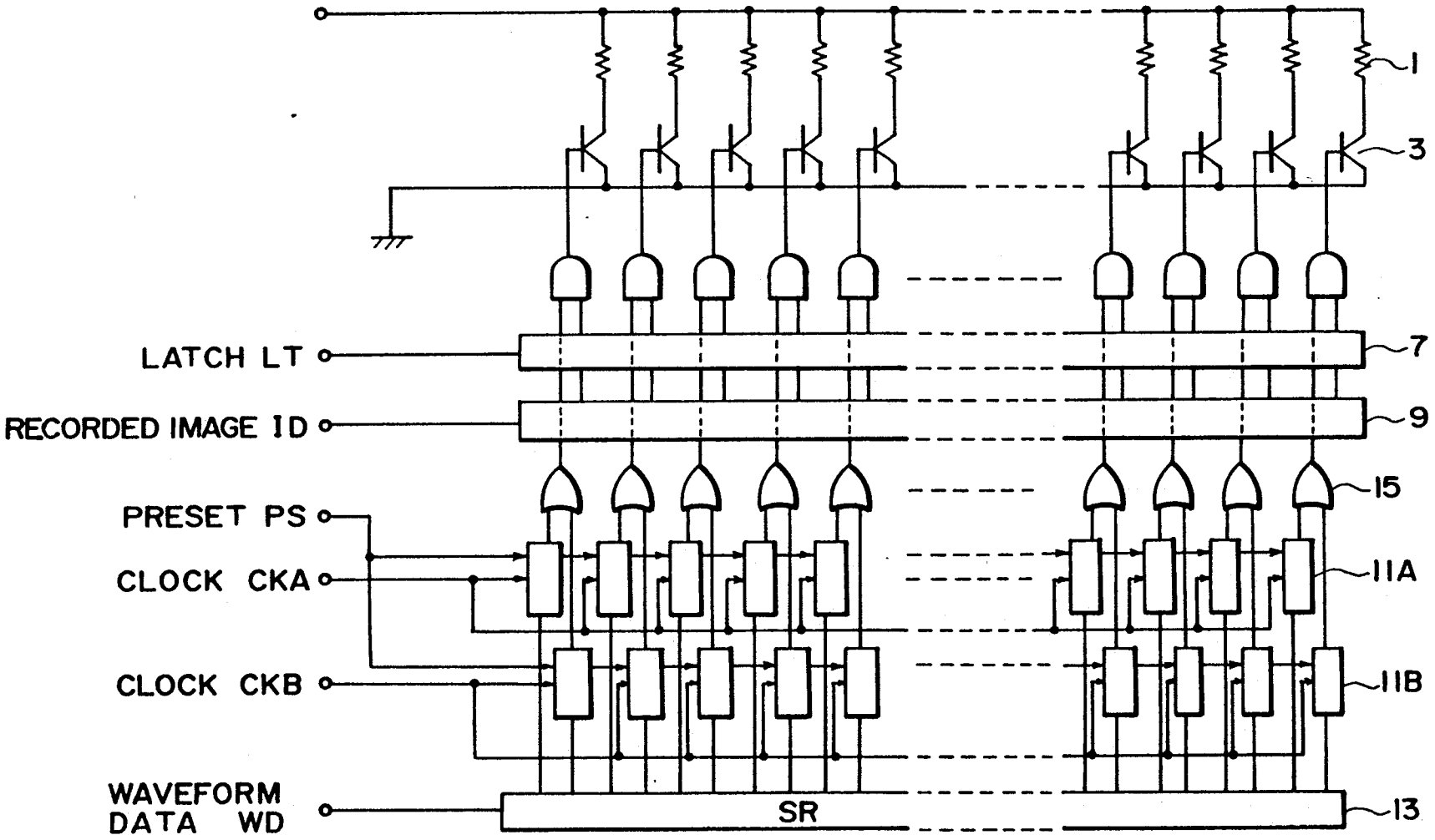
FIG. 5 is a circuit block diagram for a recording head driving circuit of a recording head or a recording apparatus according to another embodiment of the present invention.

FIG. 5 is a circuit block diagram of a recording head driving circuit of a recording head or a recording apparatus according to another embodiment of the present invention.

Figure 6:
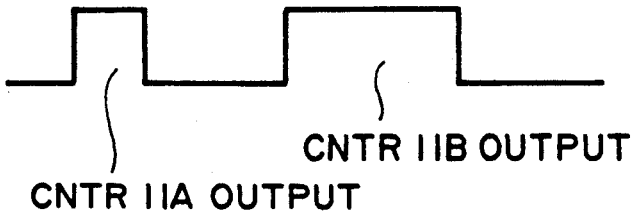
FIG. 6 shows a waveform illustrating the principle of producing a driving pulse applied to the head driving circuit of FIG. 5.

In this embodiment, two counters 11A and 11B are sequentially operated, so that the driving pulse waveform having two pulses shown in FIG. 6 can be applied. By the provision of the two counters, the bit number of the shift register 13 is increased from that of FIG. 1 structure, corresponding to the number of counters. In addition, OR gate 15 is used to obtain a logic sum of the counts of the counters 11A and 11B.

Figure 7:
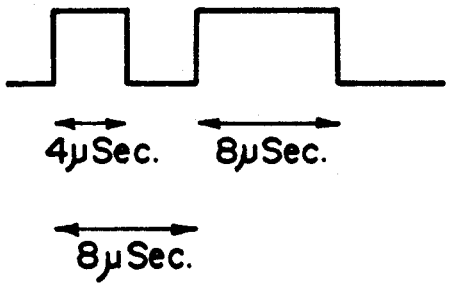
FIG. 7 shows a waveform of a driving pulse actually usable in the recording head driving circuit of FIG. 5.

As for each of the counters 11A and 11B, the levels set in accordance with the waveform data stored in the shift register 13 are "4" and "8". The frequency of the clock pulses CKA and CKB is commonly 1 MHz, and the time difference between the first pulses of the clock pulse CKA and the clock pulse CKB is 8 micro-sec., for example. Then, the driving pulse shown in FIG. 7 is obtained. Using the pulse waveform divided into two, the range in which the quantity of the ejected ink droplet is expanded, and therefore, the correction of the ejection quantity variation is effectively performed. The quantity of the ink can be controlled by controlling the temperature of the ink because the viscosity of the ink is dependent on the temperature thereof. The first part of the two pulses may be used to control the temperature of the ink, thus permitting a long range ink ejection quantity control.

Figure 8:
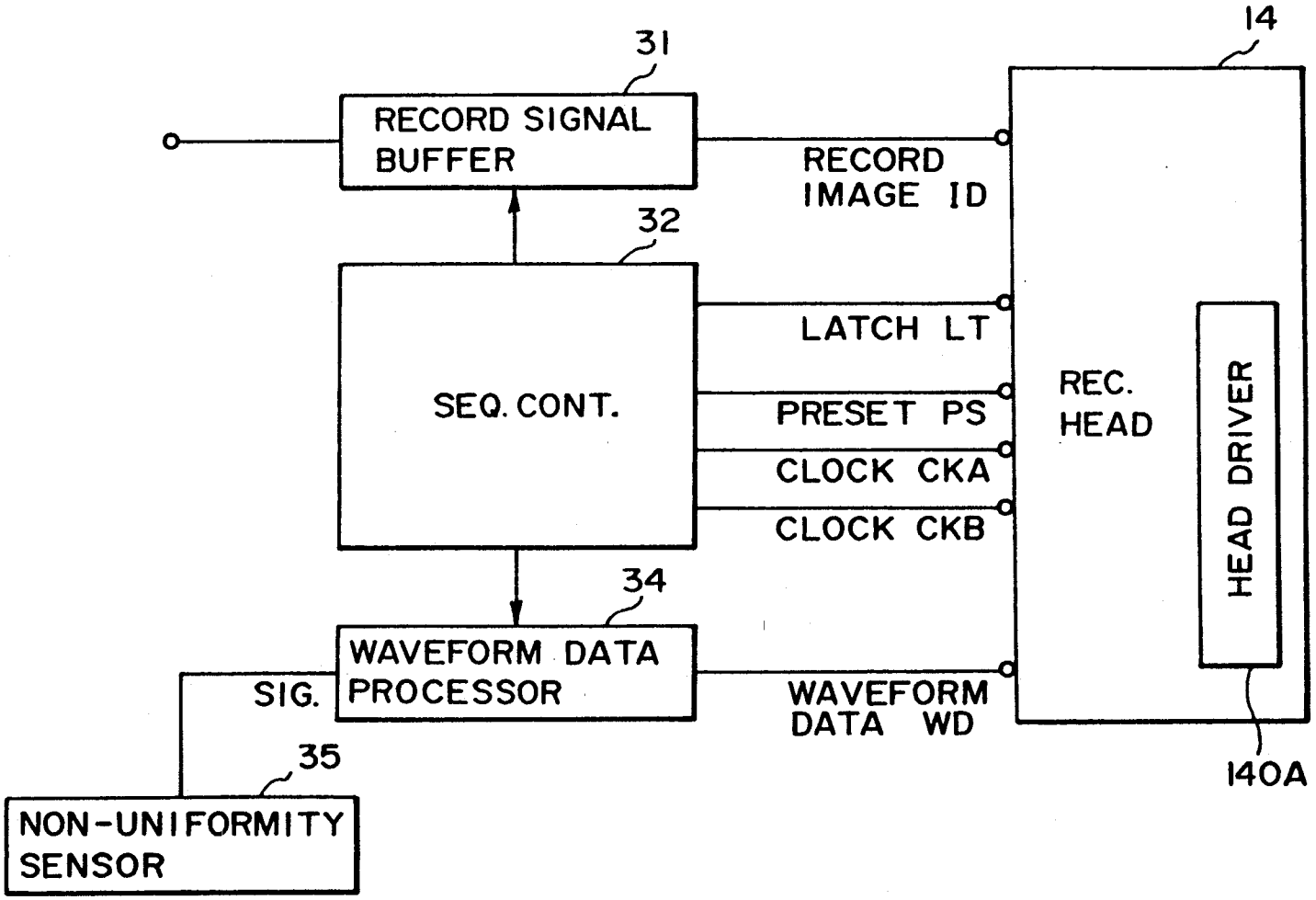
FIG. 8 is a block diagram of a control system for controlling the recording head driving circuit of FIG. 5.

FIG. 8 is a block diagram of a controller for an ink jet recording apparatus using the recording head driver circuit shown in FIG. 5. In this example, a sample image is recorded using the driving pulse of the waveform which has been set, and then, the provided image is optically read by a non-uniformity detector 35. By doing so, the actual image density non-uniformity can be detected. The image non-uniformity signal provided is transferred to a waveform data processor 34 which determines for the respective heat generating elements such drive pulse waveforms as to provide uniform image density for the picture elements provided by the ink droplets from the heat generating elements. Thereafter, the data are stored. The waveform data WD are constituted by 3 bits corresponding to the counter 11A and 4 bits corresponding to the counter 11B, that is, 7 bits in total. Then, it is transferred to the recording head driver circuit 140A in the form of a 1 bit serial signal.

Figure 9:
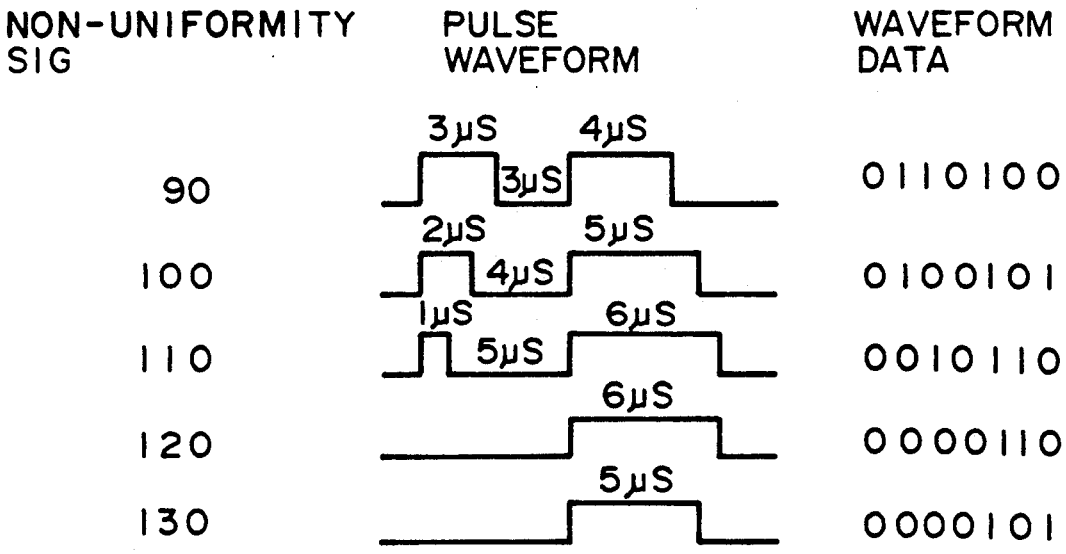
FIG. 9 shows a relation between image density non-uniformity signal and a waveform of a driving pulse for correcting the non-uniformity.

FIG. 9 shows a relation between the waveform of the driving pulse and the image non-uniformity signal in this embodiment. In FIG. 9, the level of the image density non-uniformity signal increases with increase of the detected image density. Therefore, with the increase of the level of the non-uniformity signal, a pulse waveform providing smaller quantity of the ink ejection is selected in order to suppress the image density.

In experiments using the apparatus of this embodiment, the clock pulses CKA and CKB commonly had the frequency of 1 MHz, and the time difference between the clockpulses CKA and CKB was 6 micro-sec. The recorded images were of high quality without non-uniformity in the image density.

In the foregoing embodiments, the means for storing the waveform data WA for the driving pulses of the head driver circuit has been described as a shift register, but it may be in another form if it has a storing function. It may be, for example, RAM, ROM, flip-flop circuit or the like.

The waveform data WD is not limited to the one inputted serially bit by bit.

The present invention is not limited to the case wherein the pulse waveform is determined for each of the heat generating elements, but the pulse waveform is determined for every 8 heat generating elements, for example. With such a structure, a sufficiently high quality image can be provided.

In the foregoing, the description has been made with respect to a heat generating element used in an ink jet recording head. However, the present invention is applicable to a heat generating element in a thermal type recording head of a thermal transfer type or a heat sensitive type. In addition, the present invention is applicable to a recording element using other than thermal energy, for example, a piezoelectric element.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multicolor mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is also applicable to other types of ink. In one such ink, the temperature rise due to the thermal energy is positively prevented by consuming it for the state change of the ink from the solid state to the liquid state. Another ink material is solidified when it is unheated, to prevent the evaporation of the ink. In either of the cases, upon application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective system for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, the waveform data for the driving pulse is stored in a memory circuit, and the driving pulse for the waveform data can be applied to the associated heat generating elements corresponding to the record image signal.

As a result, the waveform data signal for the driving pulse is not used also as the recording signal, and therefore, the bulky circuit for effecting the waveform data control in synchronism with the transfer of the recording image signal can be omitted. By doing so, the structure of the recording head is simplified. In addition, the correction of the property variation among the heat generating elements can be effected quickly by the waveform data.

According to the present invention, the size of the recording element part can be reduced in a recording apparatus particularly in the recording apparatus having plural full-line recording heads having a great number of thermal energy generating elements at a high density. Therefore, the sizes of the entire facsimile, copying, word processor machine or the like or another printer can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A recording head using thermal energy to eject ink, said recording head comprising:

a plurality of heat generating elements for producing thermal energy in response to driving signals to cause a change of state in the ink to eject the ink;

waveform storing means for storing waveform data for at least one of the driving signals applied to a predetermined number of said heat generating elements, the predetermined number being at least one, wherein the waveform data defines a width of the at least one driving signal to control a quantity of the ink ejected;

counting means for counting a period in accordance with the waveform data; and driving signal applying means for applying to each of the predetermined number of said heat generating elements the at least one driving signal on the basis of the period counted by said counting means, in accordance with at least one record image signal.

2. A recording head according to claim 1, wherein the at least one driving signal includes at least two pulse signals.

3. A recording head according to claim 1, wherein the predetermined number is one.

4. A recording head according to claim 1, wherein the predetermined number is more than one.

5. A recording head comprising:

a plurality of recording elements for ejecting ink;

waveform storing means for storing waveform data for at least one driving signal applied to a predetermined number of recording elements, the waveform data defining a width of the at least one driving signal to control a quantity of the ink ejected;

counting means for counting a period in accordance with the waveform data; and driving signal applying means for applying to each of the predetermined number of recording elements the at least one driving signal on the basis of the period counted by said counting means in accordance with a record image signal.

6. A recording head according to claim 5, wherein said recording elements comprise heat generating elements that produce thermal energy in response to the at least one driving signal to cause a change of state in ink to eject the ink.

7. A recording head according to claim 6, wherein the waveform data is effective to limit a width of each driving signal to control a quantity of the ink ejected.

8. A recording head according to claim 7, wherein each of said recording elements includes a heat generating element for producing thermal energy.

9. A recording head according to claim 7, wherein the at least one driving signal includes at least two pulse signals.

10. A recording head according to claim 7, wherein the predetermined number is one.

11. A recording head according to claim 7, wherein the predetermined number is more than one.

12. A recording apparatus using thermal energy to eject ink, said apparatus comprising:

a recording heat including a plurality of heat generating elements for producing thermal energy in response to driving signals to cause a change of state in the ink to eject the ink; waveform storing means for storing waveform data for at least one driving signal applied to a predetermined number of said heat generating elements, the predetermined number being at least one, wherein the waveform data defines a width of the at least one driving signal to control a quantity of the ink ejected; counting means for counting a period in accordance with the waveform data; and driving signal applying means for applying to each of the predetermined number of said heat generating elements the at least one driving signal on the basis of the period counted by said counting means, in accordance with at least one record image signal;

transferring means for transferring the at least one record image signal to said driving signal applying means; and control means for controlling timing of the application of the at least one drive signal.

13. An apparatus according to claim 12, wherein the at least one driving signal includes at least two pulse signals.

14. An apparatus according to claim 12, wherein the predetermined number is one.

15. An apparatus according to claim 12, wherein the predetermined number is more than one.

16. An apparatus according to claim 12, further comprising waveform data setting means for transferring the waveform data to said waveform storing means to store the waveform data in said storing means.

17. An apparatus according to claim 16, wherein said setting means includes a waveform storing element for storing the waveform data in accordance with image density.

18. An apparatus according to claim 16, wherein said waveform data setting means includes image reading means for reading an image produced by said recording head before a recording operation and processing means for correcting the waveform data on the basis of data read by the reading means.

19. An apparatus according to claim 12, wherein said recording head effects a recording operation using a plurality of colors of ink.

20. A recording apparatus using a recording head including a plurality of recording elements to eject ink, said apparatus comprising:

waveform storing means for storing waveform data for at least one driving signal applied to a predetermined number of the recording elements, the predetermined number being at least one, wherein the waveform data defines a width of the at least one driving signal to control a quantity of the ink ejected;

counting means for counting a period in accordance with the waveform data;

driving signal applying means for applying to each of the predetermined number of the recording elements the at least one driving signal on the basis of the period counted by said counting means, in accordance with at least one record image signal;

transferring means for transferring the at least one record image signal to said driving signal applying means; and control means for controlling timing of the application of the at least one driving signal.

21. An apparatus according to claim 20, wherein each of said recording elements include a heat generating element for producing thermal energy.

22. An apparatus according to claim 21, wherein said heat generating elements produce thermal energy in response to the at least one driving signal to cause a change of state in ink to eject the ink.

23. An apparatus according to claim 22, wherein the waveform data is effective to limit a width of the at least one driving signal to control a quantity of the ink ejected.

24. An apparatus according to claim 20, wherein the predetermined number is one.

25. An apparatus according to claim 20, wherein the predetermined number is more than one.

26. An apparatus according to claim 20, further comprising waveform data setting means for transferring the waveform data to said waveform storing means to store the waveform data in said storing means.

27. An apparatus according to claim 26, wherein said setting means includes a waveform storing element for storing the waveform data in accordance with image density.

28. An apparatus according to claim 26, wherein the waveform data setting means includes image reading means for reading an image produced by said recording head before a recording operation and processing means for correcting the waveform data on the basis of data read by said reading means.

29. An apparatus according to claim 20, further comprising an image signal storing circuit for storing the at least one recording image signal.

30. An apparatus according to claim 29, further comprising an original reader for supplying the at least one record image signal to said image signal storing circuit.

31. An apparatus according to claim 29, further comprising image signal input means for supplying the at least one record image signal to said image signal storing circuit.

32. An apparatus according to claim 20, wherein the at least one driving signal includes at least two pulse signals.

33. An apparatus according to claim 20, wherein the recording elements are arranged over an entire recording width of a recording medium.

34. A recording method using a recording head having a plurality of recording elements, said method comprising the steps of:

storing waveform data for at least one driving signal applied to a predetermined number of the recording elements, the predetermined number being at least one, wherein the waveform data defines a width of the at least one driving signal;

counting a time period in accordance with the waveform data;

applying to each of the predetermined number of the recording elements a record image signal;

outputting a driving signal to the predetermined number of the recording elements on the basis of the time period counted in said counting step, in accordance with the applied record image signal; and repeating during a recording operation said counting step, applying step and outputting step.

35. An apparatus according to claim 34, wherein said storing step is executed after a main switch for supplying power to the recording head is actuated.

36. An apparatus according to claim 34, wherein each of the recording elements includes a heat generating element for producing thermal energy.

37. An apparatus according to claim 34, wherein the at least one driving signal includes at least two pulse signals.

38. A method according to claim 34, wherein the predetermined number is one.

39. A method according to claim 34, wherein the predetermined number is more than one.

40. A method according to claim 34, wherein the recording elements comprise heat generating elements that produce thermal energy in response to the at least one driving signal to cause a change of state in ink to eject the ink.

41. A method according to claim 34, wherein the waveform data is effective to limit a width of the at least one driving signal to control a quantity of the ink ejected.

* * * * *

UNITED STATES PATENT AND TRADEMARK OFFICE

CERTIFICATE OF CORRECTION

PATENT NO. : 5,305,024

DATED : April 19, 1994

INVENTOR(S) : Haruhiko MORIGUCHI, et al.

It is certified that error appears in the above-indentified patent and that said Letters Patent is hereby corrected as shown below:

On title page, item

AT [56] REFERENCES CITED - FOREIGN PATENT DOCUMENTS:

"031828 5/1989 European Pat. Off." should read --0318328 5/1989 European Pat. Off.--.

COLUMN 7:

Line 56, "is the" should read --is applied. The--.

COLUMN 9:

Line 25, "claim 7," should read --claim 5,--;
Line 28, "claim 7," should read --claim 5,--;
Line 31, "claim 7," should read --claim 5,--;
Line 33, "claim 7," should read --claim 5,--.

Signed and Sealed this

Twenty-ninth Day of November, 1994

Bruce Lehman

*Attest:*

BRUCE LEHMAN

*Attesting Officer*

*Commissioner of Patents and Trademarks*

--